United States Patent [19]

Zylbert et al.

[11] 4,397,250

[45] Aug. 9, 1983

[54] THREAD CONTROLLING ARRANGEMENT FOR BOBBIN WINDING MECHANISM

[75] Inventors: Thaddeus J. Zylbert, Morris Plains; Herbert T. Hurler, Elizabeth, both of N.J.

[73] Assignee: The Singer Company, Stamford, Conn.

[21] Appl. No.: 294,854

[22] Filed: Aug. 20, 1981

[51] Int. Cl.[3] ..... D05B 57/26; D05B 59/00

[52] U.S. Cl. ..... 112/184; 112/231; 112/279

[58] Field of Search ..... 112/181, 184, 228, 229, 112/231, 279

[56] References Cited

U.S. PATENT DOCUMENTS

| | | | |
|---|---|---|---|
| 2,746,408 | 5/1956 | Ayres | 112/229 |
| 3,407,760 | 10/1968 | Ketterer | 112/184 |
| 3,490,402 | 1/1970 | Ketterer | 112/184 |
| 3,693,565 | 9/1972 | Ketterer | 112/184 |
| 3,693,566 | 9/1972 | Ketterer | 112/184 |
| 4,259,914 | 4/1981 | Johnson | 112/184 |
| 4,326,474 | 4/1982 | Zylbert | 112/184 |

*Primary Examiner*—Wm. Carter Reynolds

*Attorney, Agent, or Firm*—William V. Ebs; Robert E. Smith; Edward L. Bell

[57] ABSTRACT

A sewing machine bobbin case is provided with a thread tensioning device that includes a pivotally movable arm which is spring biased into a position preventing thread from entering the device during the sewing of materials on the machine, but which is disposable by a finger in a position providing for the introduction of thread into the device in preparation for the performance of a bobbin winding operation.

9 Claims, 13 Drawing Figures

24
140
79
188
78
76
80
72
74
77
122
216
136
214
120
138
114
112
172
115
126
130
116
186
117
118
124
128
84
86
108
102
106
110
92
204
206
210
218
200
202
98
94
104
212
64
70
68
66
100
62
82
96
61
58
26
208
90
88
28
56
154
54
149
148
148
149
152
160
150
162
168
166
164
50
44
46
52
48
42
40
55
10
14
120
16

THREAD CONTROLLING ARRANGEMENT FOR BOBBIN WINDING MECHANISM

BACKGROUND OF THE INVENTION

1. Field of the Invention

The invention is directed to an arrangement for preventing the introduction of thread into a bobbin thread tensioning device during a sewing operation and providing for the introduction of thread into such device when a bobbin winding operation is to be performed.

2. Description of the Prior Art

It is well known to provide a lockstitch sewing machine with bobbin winding mechanism as shown, for example, in U.S. Pat. No. 3,693,566 of The Singer Company issued Sept. 26, 1972. Such mechanism has been designed to provide for the introduction of needle thread by way of a thread guiding finger into a bobbin case thread tensioning device when a bobbin winding operation is to be performed, but to prevent needle thread carried by the looptaker of the machine from entering the tensioning device during sewing operations. However, in order to have the machine so perform, manufacturing tolerances at the location of the bobbin case and the tensioning device, where thread was to be introduced to the device for bobbin winding but prevented from entering during sewing operations, had to be prescribed within narrow limits. Adherence to such tolerances materially added to the cost of producing a machine. Further, even in a machine built to satisfy such dimensional tolerances, it sometimes happened that thread would fail to enter the bobbin case tensioning device when the machine was instructed to initiate a bobbin winding operation.

It is a prime object of the present invention to provide an improved arrangement effective to reliably control the movement of thread into and over a bobbin case tensioning device as required for bobbin winding and sewing respectively, without the need for an adherence to tight dimensional tolerances during the manufacture of the bobbin case or tensioning device.

Other objects and advantages of the invention will become apparent during a reading of the specification taken in connection with the accompanying drawings.

SUMMARY OF THE INVENTION

In accordance with the invention, a thread tensioning device on the bobbin case of a lockstitch sewing machine is provided with a pivoted arm which is biased by a spring into a closed position in engagement with a shoulder on the bobbin case to prevent the movement of thread carried by the looptaker of the machine into the tensioning device when the machine is being used to sew but which is held by a cam and a moveable finger in a lifted position permitting thread to enter said device when a bobbin winding operation is to be performed. The cam carrying finger is preferably spring biased into the said position of engagement with the pivoted arm and movable therefrom by a slide effective to actuate bobbin winding mechanism as hereinafter described.

DESCRIPTION OF PREFERRED EMBODIMENT OF THE INVENTION

Figure 1:
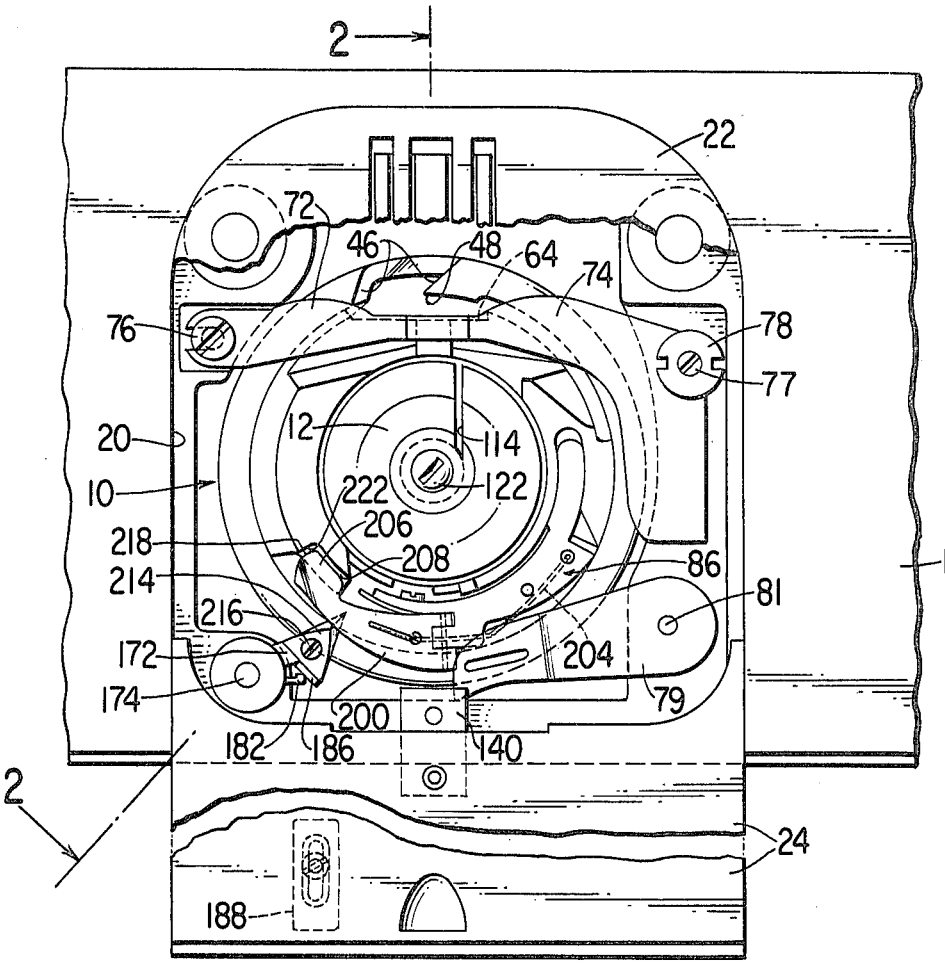
FIG. 1 is a top plan view of a portion of the bed of a sewing machine showing a thread controlling arrangement for bobbin winding mechanism according to the invention as revealed with a slide cover plate for the looptaker of the machine in an open position.

Referring to the drawings, reference character 10 designates a looptaker suitable for use in various model sewing machines of which the machine shown in U.S. Pat. No. 2,862,468 issued Dec. 2, 1958 to R. E. Johnson is an example. Such patent is incorporated herein by reference and may be referred to for disclosure of all of the sewing machine mechanism save for the looptaker and mechanism disclosed herein for controlling the winding of thread on a bobbin 12.

As shown, looptaker 10 includes as an integral part thereof, a hollow shaft 14 which is journalled in a bushing 16. The bushing is carried in sewing machine bed 18 which is formed with an upwardly open looptaker accommodating cavity 20. A throat plate 22 partially covers the cavity and a slide plate 24 is movable over the remaining portion of the opening.

Turning movement is imparted in one direction during operation of the sewing machine to the looptaker 10 by a bevel gear 26 made fast on the looptaker shaft by a set screw 28 and in mesh with a bevel gear 30 on a driving bed shaft (not shown). Preferably, the looptaker makes two revolutions during each cycle of endwise reciprocation of a needle 36 which cooperates therewith in the formation of stitches passing through a needle hole 38 in the throat plate 22.

The looptaker 10 has an upwardly open cupshaped form including a rim 40 having an upwardly extending bearing shoulder 42. The rim is also formed with an annular inwardly extending bearing rib 44 having a lateral opening 46 formed at one side with a thread loop seizing beak 48. Needle 36 reciprocates in a path which traverses the plane containing the path of circular movement of the loop seizing beak 48. The looptaker includes a base 50 with an arcuate opening 52 to provide clearance for the tip of the needle. A thread pull-off member 54 supported on a step 55 is secured to the base 50 with a screw 56.

Constrained within the cupshaped looptaker is a bobbin case indicated generally at 58. The bobbin case is formed with an upwardly open bobbin accommodating cavity 59, and with an annular base 60 through which there extends a large central control aperture 61. Externally the bobbin case is formed with a bearing flange 62 which rests upon the bearing rib 44 of the looptaker and is constrained radially against the bearing shoulder 42. The bobbin case flange is slabbed at one side as at 64, substantially along a chord to provide clearance for the path of needle reciprocation between the bobbin case and looptaker. Adjacent to the slabbed portion 64 of the bobbin case flange, recesses 66 and 68 are provided in the bobbin case on either side of an abutment 70. Such recesses 66 and 68 receive the arms 72 and 74 of a bobbin case restraining member which is secured to the sewing machine bed 18 by screw 76, and by the screw 77 and nut 78. The arms 72 and 74 restrain upward movement of the bobbin case, and a connecting bridge 80 brackets abutment 70 to restrain rotation of the bobbin case. An arm 79 pivoted at 81 in the bed may be positioned as shown in FIG. 1 to assist in holding down the bobbin case, and may be moved off the bobbin case to permit its removal from the looptaker.

Figure 4:
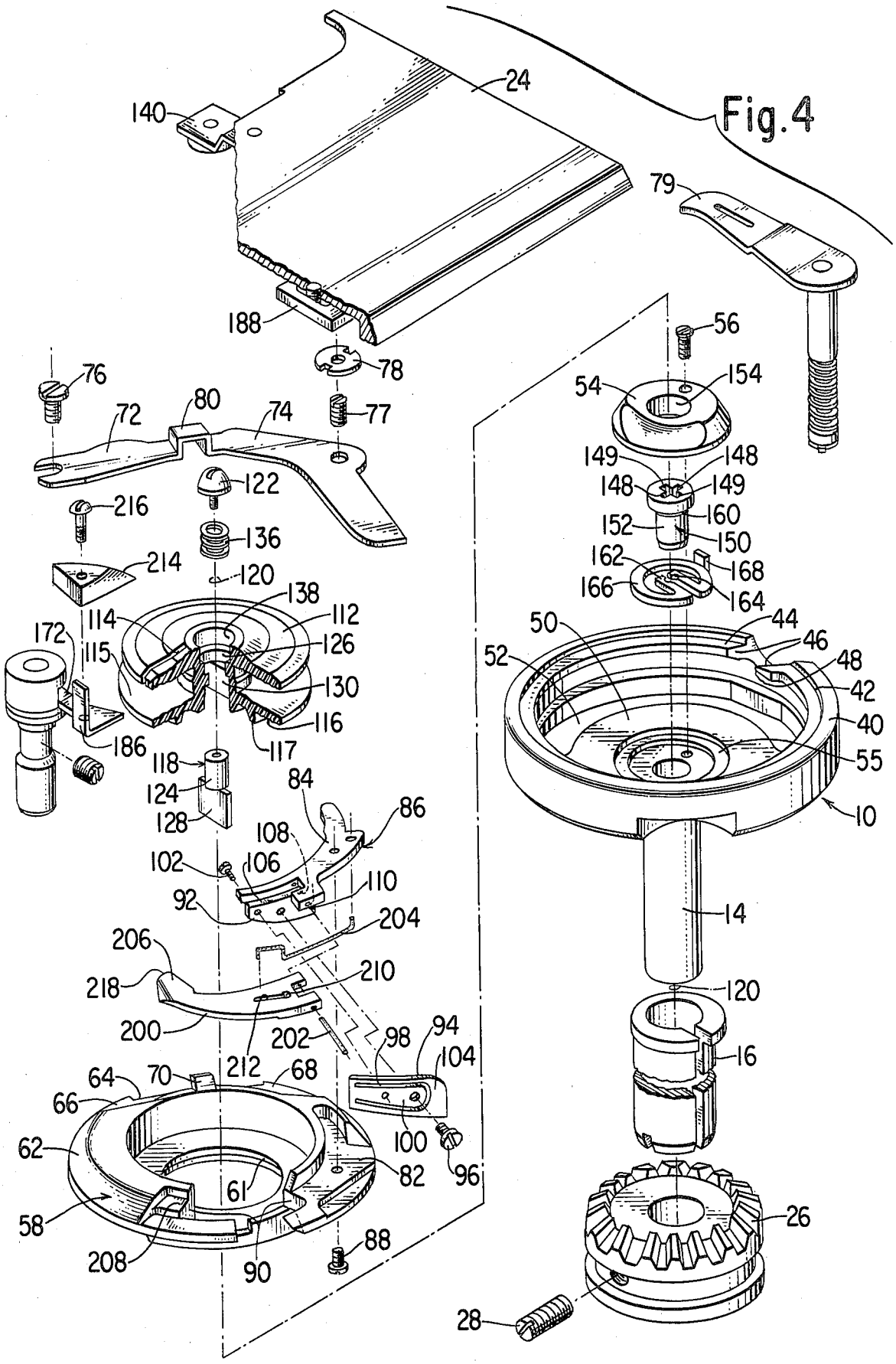
FIG. 4 is an exploded perspective view of the bobbin winding mechanism of the invention.
Figure 10:
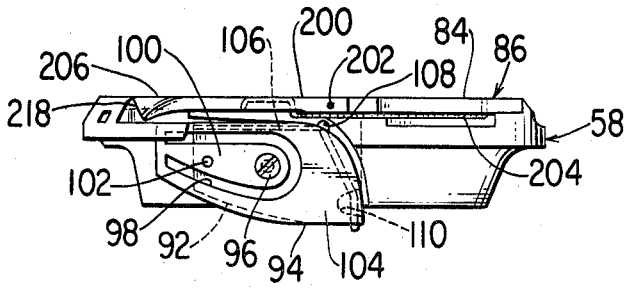
FIG. 10 is an elevational view of the bobbin case illustrating the bobbin thread tensioning spring means and showing the thread as it is located with respect to the spring means in the position of the parts as shown in FIG. 9.

The bobbin case flange 62 substantially diametrically opposite slabbed portion 64 is formed with a recess 82 in which the bracket 84 of a thread tensioning device 86 is secured by a fastening screw 88. An arm 200 is hingedly connected to bracket 84 by a pin 202, and is biased downwardly by an elongate resilient wire spring 204 toward a position of engagement of the bottom surface of an end portion 206 with a shoulder 208 on the bobbin case. As shown, one end portion of the spring is held under bracket 84 and an opposite end portion extends through a hole 210 in the arm 200 to the top side thereof where it is held in a slot 212. The bobbin case adjacent to the recess 82 in the flange is formed with a radial opening 90 across which the thread tensioning spring bracket 86 spans. A downturned arm 92 on the bracket 86 is also disposed in the bobbin case radial opening 90 and provides a mounting surface against which a bobbin thread tensioning spring 94 is secured by screws 96 and 102. As shown, spring 94 is formed with a slot 98 in the form of a U-shaped loop separating a tongue 100 through which the securing screws 96 and 102 on the bracket 86 pass. Surrounding the tongue 100 is an outer spring blade portion 104 which frictionally engages the bobbin thread against the downturned bracket arm 92 to provide bobbin thread tension. The downturned arm 92 is formed with a thread entry slot 106 which as shown in FIGS. 4 and 10 terminates in an eyelet 108 for directing the thread to the spring blade portion 104 of tensioning spring 94. Below the spring, the downturned arm 92 is formed with a thread guiding groove 110 from which the bobbin thread leaves the spring and proceeds to a stitching point. The tension exerted on the thread by the spring blade portion 104 may be adjusted by regulating the fastening screw 96.

Bobbin 12 is rotatable within cavity 59 of the bobbin case 58. The bobbin includes a top flange 112 with thread pick up means in the form of an outwardly extending slot 114 skewed slightly from a true radial position on the top flange. The bobbin further includes a bottom flange 115 with a protruding annulus 116 which rests on annular base 60 of the bobbin case, and a depending boss 117 which extends into bobbin case aperture 61. Rotation of the bobbin for bobbin winding is controlled by mechanism as disclosed in U.S. patent application Ser. No. 259,718 of The Singer Company for "In Place Bobbin Winding Mechanism for a Sewing Machine" filed May 1, 1981. Such mechanism includes a plunger 118 mounted in the bobbin for slidable movement along the bobbin's axis of rotation 120. The plunger includes a top button-type screw in head 122, a cylindrical portion 124 slidable in a central bobbin aperture 126, and a key portion 128 slidable in a key accommodating slot 130 in the bobbin. A biasing spring 136 surrounding cylindrical portion 124 of the plunger under button type head 122, and located in a deep recess 138 in the bobbin, urges the plunger upwardly to a raised position defined by engagement of the upper ends of key 128 with the upper end of the bobbin slot 130 (see FIG. 2).

Figure 3:
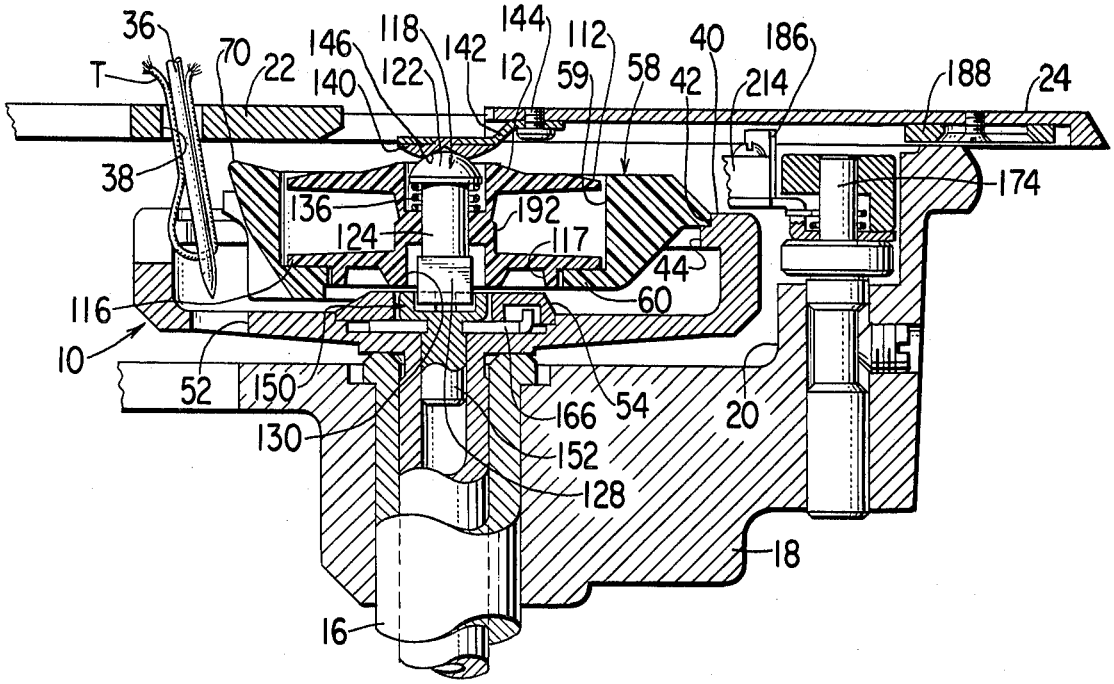
FIG. 3 is a view similar to FIG. 2 showing the slide plate in a partially open position as required for bobbin winding and showing a needle thread loop presented for seizure by the looptaker.
Figure 5:
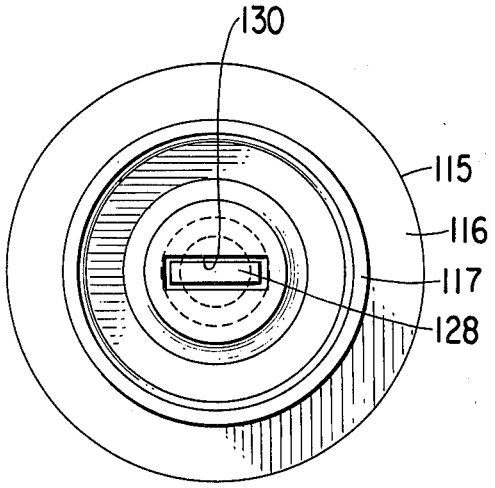
FIG. 5 is a bottom view of the bobbin.

A cam 140 is provided on the slide plate 24 to engage and urge the plunger 118 downwardly in the bobbin 12 against the biasing spring 136 when the slide plate is in a partially open position. As shown, the cam 140 is attached by way of a flexible arm 142 to the underside of the plate at 144 and includes a recessed surface 146. Recessed surface 146 and the surface of button-type head 122 include complementary contacting portions which serve to hold the plate stationary while the cam is directly over head 122. The downward urging of plunger 118 by cam 140 in the partially open position of plate 24 causes a bottom end portion of the key 128 on the plunger, during operation of the machine, to enter a key accommodating crossed slot 148 or 149 in the upper end of a chuck 150 when the slot is rotationally aligned to receive the key (see FIG. 3). The plunger is thereby coupled to the chuck to provide for rotation of the bobbin 12 with the looptaker 10, and the winding of thread on the bobbin.

As shown, chuck 150 includes a stub shaft 152 which is mounted for rotation in hollow looptaker shaft 14 about the axis 120, such axis being common to both the plunger 118 and shaft 14. The upper end of chuck 150 including key accommodating slots 148 and 149 is located in an opening 154 in bobbin thread pull-off member 54 which as already noted, is secured to looptaker 10 with screw 56. Such pull-off member serves a well understood function in pulling off and positioning bobbin thread during a sewing cycle as described, for example, for bobbin thread pull-off structure in U.S. Pat. No. 3,693,565 of Sept. 26, 1972. The chuck 150 is frictionally engaged in an annular groove 160 extending about stub shaft 152 by the end portions 162 and 164 of a spring clutch 166 having a tang 168 thereon which extends into a slot 170 in the pull-off member to establish a driving connection between the pull-off member and chuck through the clutch.

A finger 172 having a cam 214 affixed thereon by a screw 216 is pivotally mounted in bed 18 on a pin 174 located opposite hinged arm 200. Finger 172 is biased by a torsion spring 180 toward a position of engagement with a stop 182, and is caused by the spring to assume such position whenever the slide plate 24 is in any position except a fully closed position. Whenever the finger moves into the stop engaged position, hinged arm 200 is lifted by cam 214 from an engaged position with the bobbin case shoulder 208 to a position wherein the extreme end 218 of the arm is above the top surface 220 of the bobbin case. As opening 222 between the arm and bobbin case is thereby provided permitting needle thread carried by the looptaker 10 across top surface 220 to move into the thread tensioning device 86. The hinged arm 200 is held in its lifted position by cam 214 until finger 172 is moved away from stop 182. As shown, finger 172 includes an upstanding tang 186. The tang 186 is engaged by a slidably adjustable cam 188 on the underside of slide plate 24 when the slide plate is moved to its fully closed position and the finger 172 is then moved to and held by the cam 188 in a position permitting spring 204 to return arm 200 to its position of engagement with shoulder 208. In such position of the arm 200, opening 222 is closed and needle thread carried by the looptaker is prevented from entering thread tensioning device 86.

When it is desired to replenish thread on the bobbin 12, an operator detains the free end of thread extending from the eye of needle 36 above the throat plate 22, and moves slide plate 24 into its partially closed position wherein cam 140 is caused to engage head 122 of plunger 118, and spring 180 is permitted to move finger 172 into the position where arm 200 is lifted by cam 214. The operator then initiates operation of the machine to cause reciprocation of the needle 36 and rotation of the looptaker 10. The plunger 118 which is coupled to chuck 150 by the downward urging of cam 140, as described hereinbefore, is rotated by the looptaker attached pull-off member 54 acting through spring clutch 166 and the chuck 150. Bobbin 12 is rotated by the plunger acting through key 128.

Figure 6:
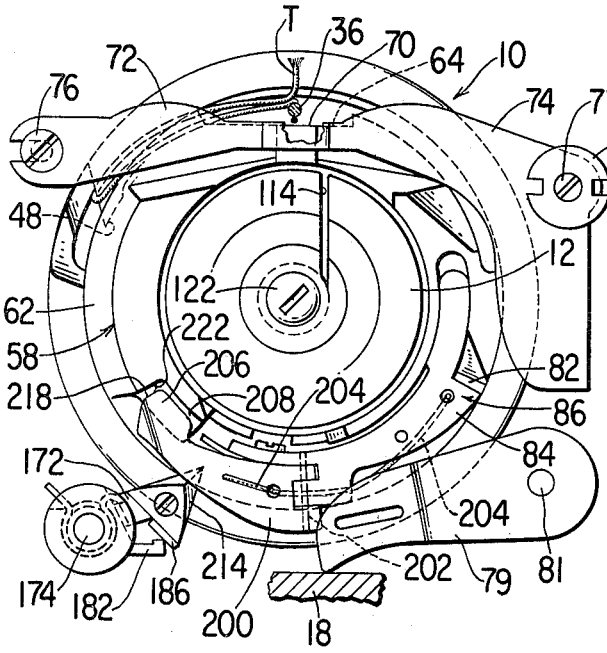
FIG. 6 is a top plan view of the looptaker with mechanism for use in the replenishment of bobbin thread shown in operative condition for bobbin winding and with the looptaker beak in a position just after seizure of a thread loop from a needle.
Figure 7:
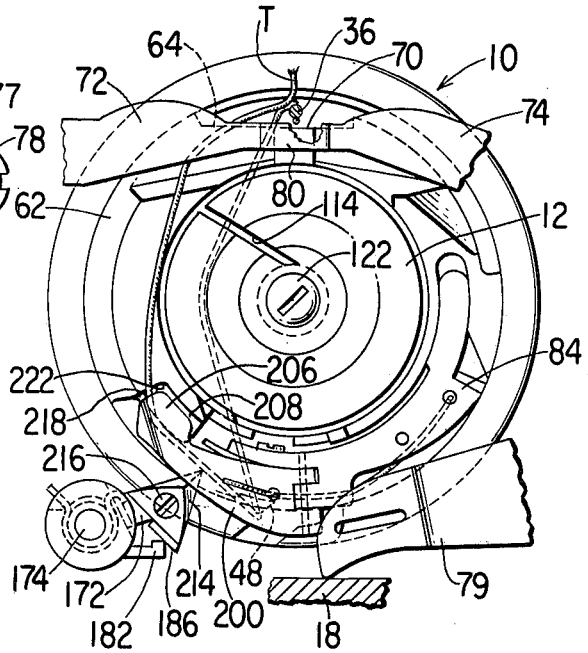
FIG. 7 is a top plan view similar to FIG. 6 but showing the hook in a position in which the thread loop seized thereby is being introduced to bobbin thread tensioning means.
Figure 11:
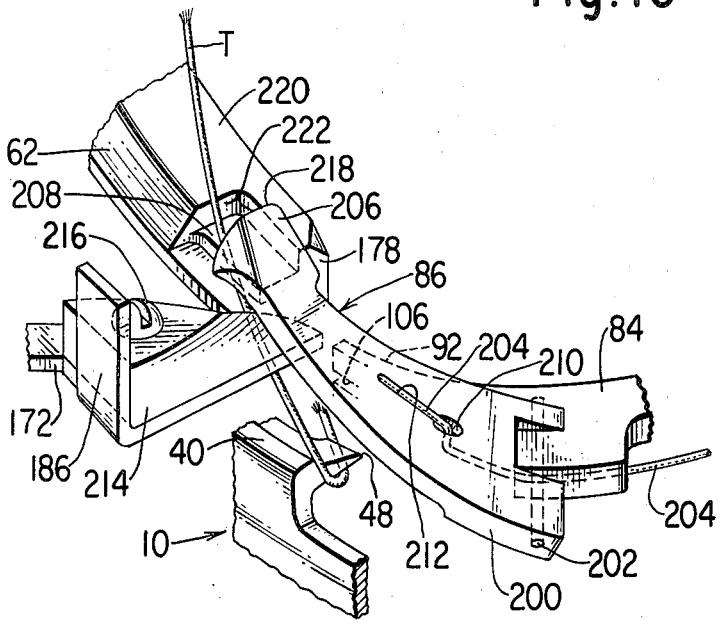
FIG. 11 is a perspective view showing a fragment of the bobbin case, thread tensioning means, camming finger and hook beak, and showing thread being directed to the thread tensioning means while the slide plate cover is in a partially closed position.

On the first dip of the needle, both limbs of the needle thread through the eye of the needle depend downwardly through the needle aperture in the throat plate, and the looptaker beak 48 seizes the needle thread loop as illustrated in FIG. 6. As rotation of the looptaker continues, the seized needle thread loop separates into an upper loop extending over the bobbin case and a lower loop extending thereunder. As the upper loop, which is the free end of the needle thread loop from the needle eye detained above the throat plate, is moved across the bobbin case surface 220, it is caused to enter opening 220 (see FIGS. 7 and 11). The thread next moves into the thread tensioning device 86 by way of thread entry slot 106. Th needle thread at this stage will have been introduced between the downturned arm 92 of the bracket 86 and the blade 104 of the thread tensioning spring but the thread will not as yet have been introduced into the bobbin, nor will the thread have been cast loose from the looptaker beak and drawn into the thread guiding groove 110.

Figure 8:
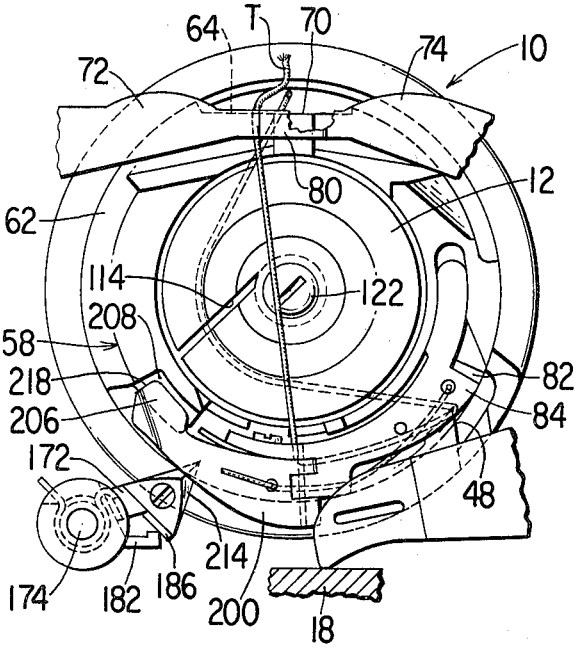
FIG. 8 is a top plan view similar to FIG. 6 but showing a position of parts in which the thread loop is about to be shed from the looptaker beak.
Figure 9:
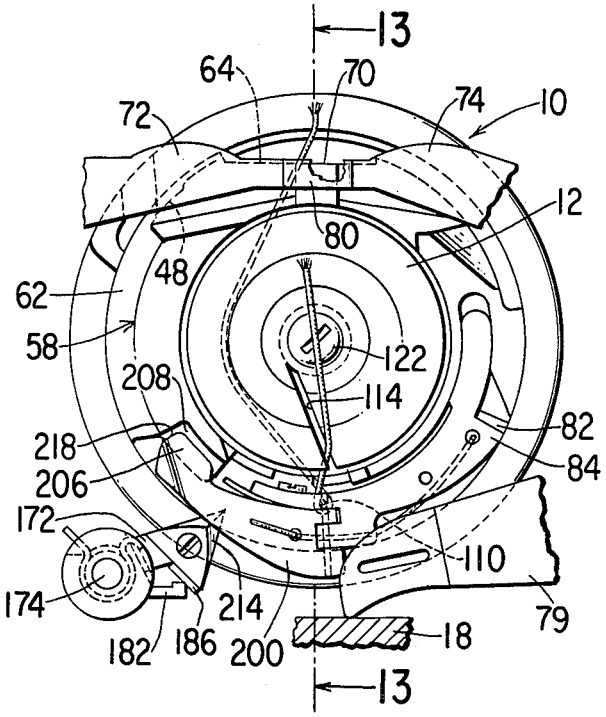
FIG. 9 is a top plan view similar to FIG. 6 but showing a position in which the thread loop is entering a bobbin flange slot.
Figure 13:
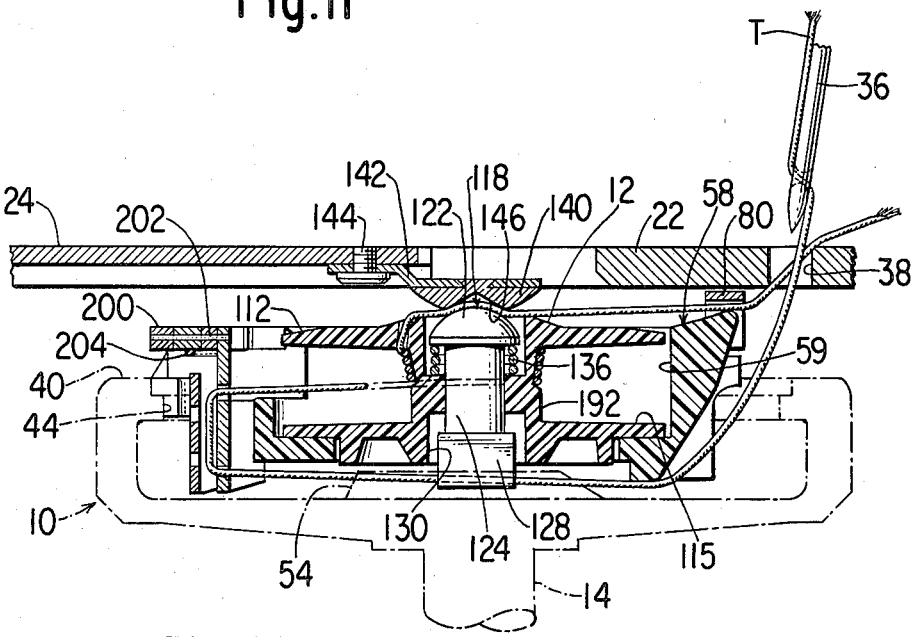
FIG. 13 is a cross-sectional view through the rotary hook taken substantially along the line 13—13 of FIG. 9 but showing the position of the thread after several rotations of the bobbin during thread replenishment and indicating the manner in which an end of the thread is severed.

As rotation of the looptaker beak continues beyond the position shown in FIG. 8, the needle thread loop is drawn off the looptaker beak 48. Rotation of the bobbin results in skewed bobbin slot 114 being moved under the upper limb of the needle thread loop. Such upper limb enters the bobbin through slot 114 and is wrapped around the hub 192 of the bobbin. As wrapping of the thread continues, slack is dissipated in the thread and it is drawn into the groove 110 (see FIG. 9). The upper limb of thread is moved across the cam 140 and the thread is severed at the cam by abrading action of the thread thereon due to rotation of the bobbin (FIG. 13). Thereafter, continued rotation of the bobbin serves to wind thereon replenishment thread for later use as bobbin thread in the formation of lockstitches.

Figure 2:
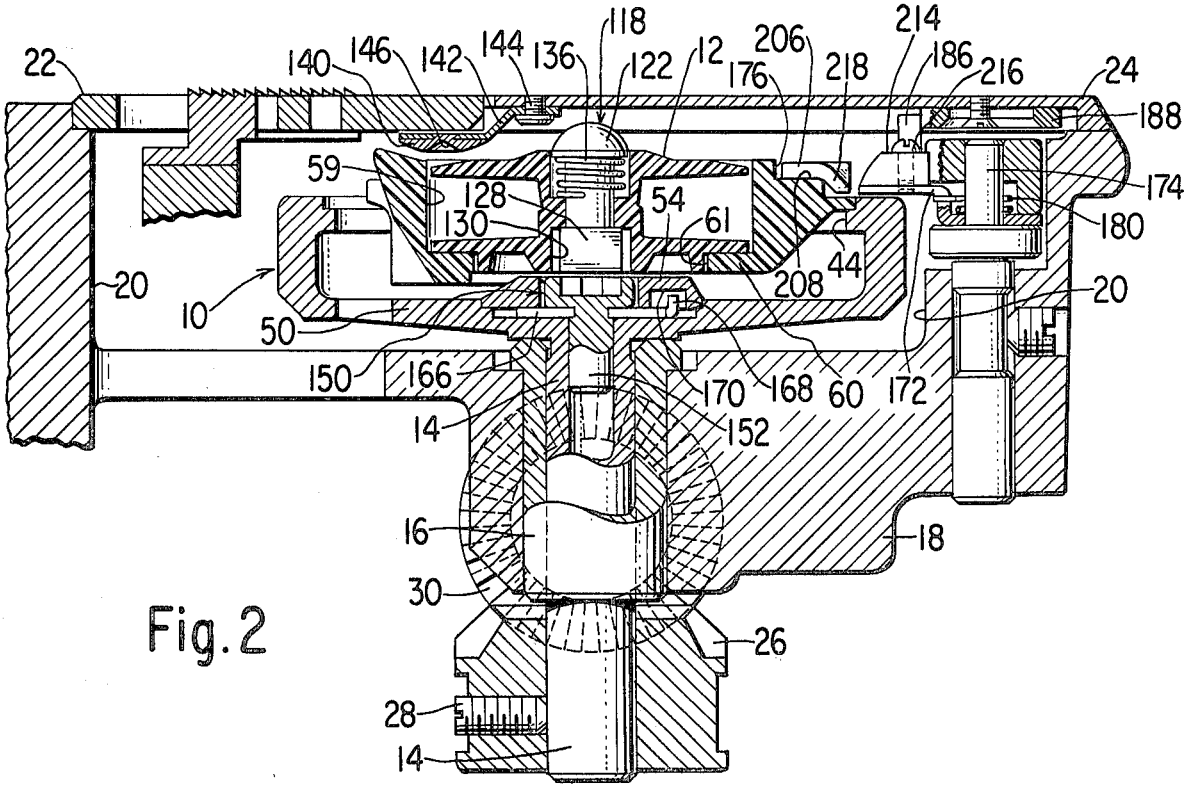
FIG. 2 is a fragmentary vertical sectional view taken through the bed substantially on the plane of the line 2—2 of FIG. 1, and showing the slide plate in a fully closed position.
Figure 12:
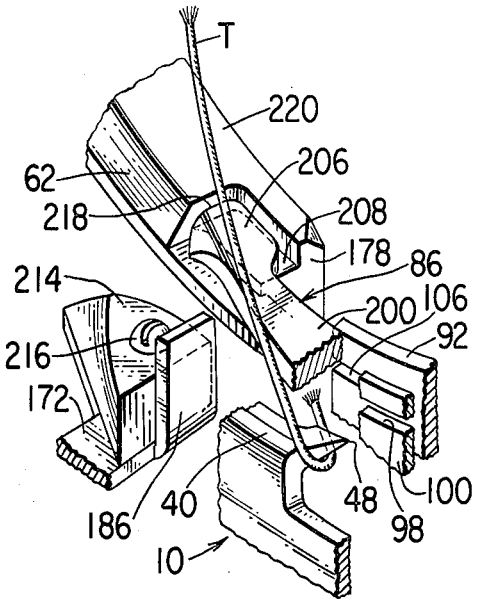
FIG. 12 is a view similar to FIG. 11 showing a needle thread loop by passing the bobbin thread tensioning means during sewing.

After the bobbin has been replenished with thread, the slide plate 24 is moved to a fully closed position (FIG. 2). The cam 140 is thereby moved off the head of plunger 118 and the plunger is raised by spring 136 to disengage the plunger from chuck 150, and so discontinue rotation of the bobbin by the looptaker. Movement of the slide plate 24 into the fully closed position brings cam 188 into engagement with tang 186 on finger 172 and causes the finger to be moved away from the bobbin case, whereupon arm 200 is moved by spring 204 to engage bobbin case shoulder 208 and so close opening 222. With opening 222 closed, (FIG. 12), the movement of thread into tensioning device 86 is prevented and lockstitches may be formed in a manner well understood in the art.

A particular embodiment of the invention has been shown and described by way of illustration. However, many modifications will occur to those skilled in the art, and it is to be understood that it is intended to cover all changes and modifications falling within the true spirit and scope of the invention as set forth in the annexed claims.

We claim:

1. In a lockstitch sewing machine, a cupshaped circular moving looptaker including a peripheral rim formed with a thread seizing beak; a non-rotatable bobbin case supported in the looptaker; a rotatable bobbin within the bobbin case; an endwise reciprocable needle movable into a position for presenting a loop of needle thread to the looptaker for seizure; a thread tensioning device carried by the bobbin case and including a thread entering slot; a movable arm on the bobbin case; a spring which biases said arm into a position on the bobbin case preventing thread carried by the looptaker from entering the thread tensioning device by way of said slot; a finger with a camming portion, said finger being movable into engagement with said arm for lifting the arm from the position preventing thread from entering the tensioning device and for disposing the arm in a position wherein thread carried by the looptaker can pass under the arm to enter said slot of the tensioning device; thread pick up means on the bobbin; and means for rotating the bobbin to cause the bobbin to pick up and wind thread extending through the tensioning device onto the bobbin.

2. The combination of claim 1 wherein the arm of the tensioning device is pivotally movable.

3. The combination of claim 2 wherein the biasing spring is an elongate resilient wire member.

4. The combination of claim 1 wherein one end of the arm is pivotally mounted on a part of the tensioning device having a fixed position on the bobbin case, and the other end of said arm when in the position preventing movement of the thread is supported on a shoulder of the bobbin case.

5. The combination of claim 1 including a spring for biasing the finger into a position wherein it is engaged with said movable arm.

6. The combination of claim 5 wherein the finger is pivotally movable.

7. The combination of claim 6 wherein the spring for biasing the movable finger is a torsion spring.

8. The combination of claim 5 including means on the machine movable by an operator for moving the finger out of its engaged position with the movable arm.

9. The combination of claim 8 wherein the finger moving means is a slide plate.

* * * * *